United States Patent [19]

Walsworth

[11] 4,383,504

[45] May 17, 1983

[54] MARINE PROPULSION DEVICE WITH MECHANICAL FUEL PRESSURE OPERATED DEVICE FOR SUPPLYING A FUEL/OIL MIXTURE

[75] Inventor: Frank J. Walsworth, Waukegan, Ill.

[73] Assignee: Outboard Marine Corporation, Waukegan, Ill.

[21] Appl. No.: 324,145

[22] Filed: Nov. 23, 1981

[51] Int. Cl.[3] ..... F01M 3/00

[52] U.S. Cl. ..... 123/73 AD; 123/196 R; 184/6.28; 417/418

[58] Field of Search ..... 123/73 AD, 196 R; 184/6.28; 417/418

[56] References Cited

U.S. PATENT DOCUMENTS

| | | | |
|---|---|---|---|
| 2,935,057 | 5/1960 | Perlewitz | 123/73 AD |
| 2,938,509 | 5/1960 | Carbonero | 123/73 AD |
| 3,140,700 | 7/1964 | Nallinger | 123/73 AD |
| 3,976,040 | 8/1976 | Goggi | 123/73 AD |
| 4,142,486 | 3/1979 | Schreier | 123/173 AD |

*Primary Examiner*—Wendell E. Burns
*Attorney, Agent, or Firm*—Michael, Best & Friedrich

[57] ABSTRACT

Disclosed herein is a marine propulsion device comprising a lower unit including a lower end, and a propeller rotatably mounted in the lower end, a power head comprising an engine including a carburetor, and an output shaft drivingly connected to the propeller, a bracket assembly adapted for mounting the lower unit to the transom of a boat and for vertical tilting movement and horizontal steering movement relative to the boat, a source of oil, a source of fuel, and a device including an outlet connected to the carburetor, a first inlet connected to the oil source, and a second inlet connected to the fuel source, for pumping oil and supplying fuel or a fuel/oil mixture to the carburetor, which supplying device is operable, in response to consumption of fuel or fuel/oil mixture by the carburetor and in response to the presence of a pressure differential between the outlet and the second inlet.

41 Claims, 4 Drawing Figures

FUEL SOURCE
FUEL PUMP
OIL SOURCE

MARINE PROPULSION DEVICE WITH MECHANICAL FUEL PRESSURE OPERATED DEVICE FOR SUPPLYING A FUEL/OIL MIXTURE

BACKGROUND OF THE INVENTION

The invention relates generally to marine propulsion devices, such as outboard motors and stern drive units, including arrangements for supplying fuel and oil to internal combustion engines from separate fuel and oil sources. The invention also relates to arrangements for pumping of fuel or oil in response to the supply under pressure of the other of the fuel or oil and to arrangements for mixing the fuel and oil and for facilitating supply thereof in mixed condition to the two stroke internal engine of a marine propulsion unit.

The invention also relates to such mixing arrangements and to arrangements for varying the volumetric ratio of supplied fuel to supplied oil.

The invention also relates generally to arrangements for pumping one fluid from a first source in response to supply of a second fluid under pressure from a second source and, if desired, for mixing the fluids and delivering such mixed fluids to a point of use. In addition, the invention relates to arrangements for varying the ratio between the mixed fluids.

In the past, outboard motors manufactured under the tradename SUZUKI have included an oil pump which was supplied oil from a tank accessible through the engine shroud, which was driven by a cam rotated by the engine, and which supplied the oil so pumped to the intake manifold for mixture with the incoming supply of fuel and for delivery of the thereby mixed fuel and oil to the engine crankcase.

Also in the past, it has been proposed to use electronic apparatus to effect oil pumping and mixing thereof with fuel prior to introduction to the engine crankcase. One such device was advertised by Injectronics Corp. of Spokane, Washington.

Also in the past, the assignee hereof, has advertized an electronic fuel/lube oil metering kit for multi-cylinder outboard motors.

Attention is also directed to the following U.S. Patents:

| | | |
|---|---|---|
| Gates | 2,898,865 | August 11, 1959 |
| Perlewitz | 2,935,057 | May 30, 1960 |
| Tacchi | 3,228,560 | January 11, 1966 |
| Lyall | 3,434,490 | March 25, 1969 |
| Sparrow, et al | 3,481,318 | December 2, 1969 |
| Leitermann, et al | 3,653,784 | April 4, 1972 |
| Shaver | 3,913,551 | October 21, 1975 |
| Bron | 3,971,341 | July 27, 1976 |
| Jensen | 3,963,038 | June 15, 1976 |
| Schreiver | 4,142,486 | March 6, 1979 |
| Tucker | 4,165,759 | August 28,1979 |
| Holmes | 4,276,001 | June 30, 1981 |
| Carlyle | Re. 29193 | April 26, 1977 |

SUMMARY OF THE INVENTION

The invention provides a marine propulsion device comprising a lower unit including a lower end, and a propeller rotatably mounted in the lower end, a power head comprising an engine including fuel feeding means, and an output shaft drivingly connected to the propeller, means adapted for mounting the lower unit to the transom of a boat and for vertical tilting and horizontal steering movement relative to the boat, means adjacent the engine defining a source of oil, means defining a source of fuel, and means including an outlet connected to the fuel feeding means, a first inlet connected to the oil source, and a second inlet connected to the fuel source, for pumping oil and supplying a fuel or fuel/oil mixture to the fuel feeding means, which oil pumping and fuel supplying means is operable, in response to consumption of fuel or fuel/oil mixture by the fuel feeding means and in response to the presence of a pressure differential between the outlet and the second inlet.

The invention also provides an oil pump and fuel supply device comprising a housing including piston means reciprocably movable within the housing and dividing the housing into an inlet chamber which varies in volume in accordance with piston means movement and which is adapted to be connected to a source of fuel which is under pressure and which biases the piston means in the direction maximizing the volume of the inlet chamber, and an outlet chamber which varies in volume in accordance with piston movement and oppositely from the variation in volume of the inlet chamber and which is adapted to be connected to a point of use for the fuel, means biasing the piston means in the direction minimmizing the volume of the inlet chamber, a conduit bypassing the piston means and communicating with the inlet chamber, valve means communicating between the bypass conduit and the outlet chamber and including means defining a port in the housing communicating with the outlet chamber and a valve member movable relative to the port between opened and closed positions, means operable in response to displacement of the piston means minimizing the volume of the outlet chamber for displacing the valve member to the opened position, means operable in response to displacement of the piston means minimizing the volume of the inlet chamber for displacing the valve member to the closed position, and means adapted for communication with a source of oil for pumping oil in response to reciprocation of the piston means.

The invention also provides an oil pump and fuel supply device comprising a housing including a recess, a piston assembly located in the housing and including a piston movable in the recess and, in cooperation with the housing, dividing the recess into a variable volume outlet chamber having means adapted for delivering fuel to a delivery point, and into an inlet chamber which is variable in volume in inverse relation to variation in volume of the outlet chamber and which is adapted to communicate with a supply of fuel, means biasing the piston assembly so as to minimize the volume of the inlet chamber, valved port means communicating between the outlet chamber and the inlet chamber and including therein valve means movable between a fully open position, a partially open position, and a closed position, whereby, when the valve means is in the closed position, and when supply of fuel to said inlet chamber and drainage of fuel from said outlet chamber creates a pressure differential between the inlet and outlet chambers, the piston assembly moves against the action of the piston assembly biasing means so as to minimize the volume of the outlet chamber, means biasing the valve means in the direction toward the fully open position and operable, in response to piston assembly movement minimizing the volume of the outlet chamber, to displace the valve means to the partially open position permitting limited fluid flow from the inlet chamber to the outlet chamber when the valve biasing means exerts a force which is equal to or slightly greater than the force resulting from the pressure differential between the inlet and outlet chambers, means in the outlet chamber operable, in response to piston assembly movement minimizing the volume of the outlet chamber, to define an intermediate chamber communicating with the valved port means and providing resistance to flow from the intermediate chamber to the outlet chamber when the valve means is in the partially open position so as thereby to effect reduction in the pressure differential between the inlet chamber and the intermediate chamber and thereby to cause movement of the valve means to the fully open position, whereby to substantially reduce the pressure differential between the inlet chamber and the intermediate chamber, and thereby to cause piston assembly movement minimizing the volume of the inlet chamber in response to the action of the piston assembly biasing means, and means adapted to be connected to a source of oil for pumping oil in response to piston assembly movement.

Other features and advantages of the embodiments of the invention will become known by reference to the following general description, claims and appended drawings.

IN THE DRAWINGS

Figures 1, 2, 3:
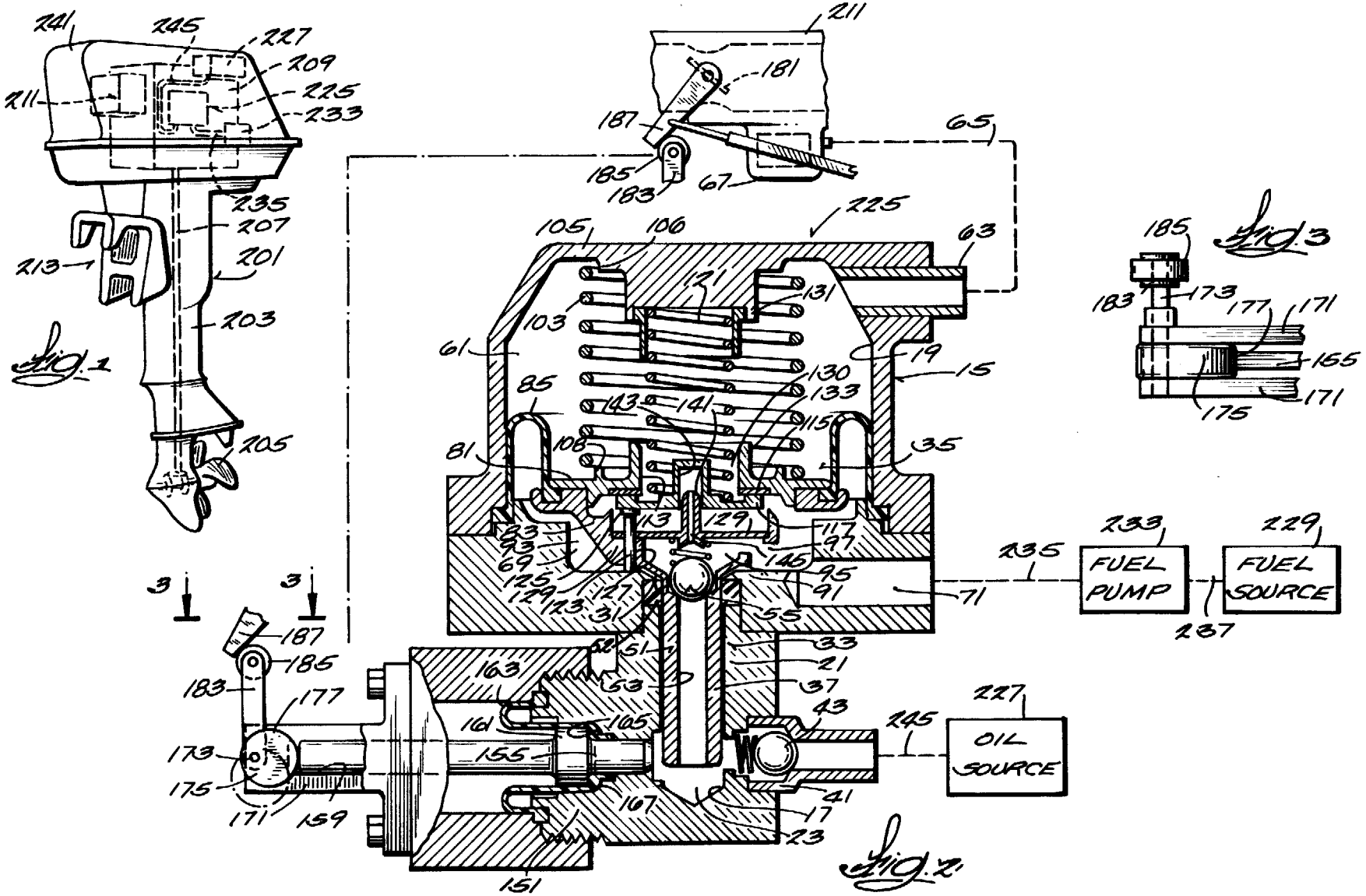
FIG. 1 is a perspective view of an outboard motor embodying various of the features of the invention.
FIG. 2 is an enlarged partially schematic and partially cross sectional view of various of the components of the outboard motor shown in FIG. 1.
FIG. 3 is a fragmentary view taken along line 3—3 of FIG. 2.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is marine propulsion device 201 which is in the form of an outboard motor but which could also be in the form of a stern drive unit. The marine propulsion device 201 includes a lower unit 203 having, at the lower end thereof, a rotatably mounted propeller 205. Drivingly connected to the propeller 205 is an output or crankshaft 207 of a two stroke internal combustion engine 209 which includes one or more combustion chambers (not shown) and means, such as a carburetor 211, for feeding or supplying fuel or fuel/oil mixture to one or more combustion chambers. Of course, other arrangements could be used for feeding or supplying or introducing fuel/oil mixture to the combustion chambers.

The marine propulsion device also includes bracket means 213 connected to the lower unit 203 and adapted for mounting the lower unit 203 to the transom of a boat and for affording vertical tilting and horizontal steering movement of the lower unit 203 relative to the boat.

The marine propulsion device 201 also includes means 225 which includes an outlet and an inlet and which is operable, in response to engine operation, and in response to a pressure differential between the inlet and the outlet, for receiving fuel from a suitable source 229 into the inlet and supplying fuel from the outlet, and for pumping oil from a source 227 separate from the fuel source 229, so as to permit, if desired, introduction of the pumped oil into the fuel delivered from the outlet and delivery thereof to the carburetor 211 or other combustion chamber fuel feeding or supplying means.

The pressure differential between the outlet and the inlet can be obtained by connecting the outlet to the suction side of a fuel pump (not shown). In the illustrated construction, the pressure differential is obtained by connecting the fuel inlet to means for supplying fuel under pressure. While various arrangements can be employed, in the illustrated construction, such means comprises a fuel pump 233 which is mounted on the engine 209, which is driven by engine operation, and which includes an output connected by suitable duct or conduit means 235 to the oil pumping and fuel or fuel/oil mixture supply means 225. The fuel pump 233 also includes an input connected by suitable conduit or duct means 237 to a fuel tank which constitutes the fuel source 229 and which is located more or less remotely from the engine 209. If desired, the fuel pump 233 could be driven electrically, or by other means independently of the engine, and could be located remotely from the engine 209. In general, any arrangement can be employed to create a pressure differential between the outlet and the inlet.

Various arrangements can be employed for communicating the oil pumping and fuel or fuel/oil mixture supply means 225 with the oil source 227. In the illustrated construction, the engine is covered by a shroud 241 and the shroud 241 is formed with an oil tank or reservoir which constitutes the oil source 227 and which is located above the oil pumping and fuel or fuel/oil mixture supply means 225 and connected to the oil pumping and fuel or fuel/oil mixture supply means 225 by suitable conduit means 245 so as to supply oil under a suitable gravity head. If desired, the oil tank or oil source 227 could be supported on the engine 209. Alternatively, oil could be supplied through a suitable conduit and oil pumping arrangements from a more or less remote source.

Preferably, the oil pumping and fuel or fuel/oil mixture supply means 225 is supported on the engine 209 in close proximity to the fuel pump 233 and the carburetor 211. However, if desired, the oil pumping and fuel or fuel/oil mixture supply means 225 could be connected to the carburetor 211 or other means for feeding or supplying fuel or fuel/oil mixture to the combustion chambers by suitable conduit means and located more or less remotely from the engine 209. In addition, the oil pumping and fuel or fuel/oil mixture supply means 225 could be integrated with an oil tank located remotely from the engine 209 or mounted adjacent the engine 209.

More particularly, with respect to the oil pumping and fuel or fuel/oil mixture supply means 225, while various other constructions could be employed, in the illustrated and preferred construction, such means comprises (see FIG. 2) a housing 15 which can constitute an assemblage of components, which can be constructed of any suitable relatively rigid material, and which is fabricated to include a first relatively small chamber or recess 17 and a second relatively large chamber or recess 19 which communicates with the first recess or chamber 17. Preferably, as shown in the drawings, the first recess or chamber 17 includes an elongated cylindrical portion 21 which can be non-circular in cross-section and which communicates with a second portion defining, in part, a pumping chamber 23 of variable volume. Preferably, the second chamber 19 is, for the most part, generally cylindrical in shape. The particular configuration of the chambers or recesses 17 and 19, except for their relative size and cooperation with a movable piston assembly 31 still to be described, is not believed to be especially significant to the invention.

The just mentioned piston assembly 31 includes connected first and second piston means 33 and 35 which are respectively movable in the first and second recesses or chambers 17 and 19. More particularly, the first piston means 33 comprises a stem or plunger 37 which matingly engages the cylindrical portion 21 of the first recess or chamber 17 and which extends into the second recess 19 so as to define, in cooperation with the housing 15, the variable volume oil pumping chamber 23. A seal 52 is located between the plunger 37 and the portion 21.

Means are provided for supplying oil to the oil pumping chamber 23. While other arrangements can be employed, in the illustrated construction, such means comprises a fitting 41 mounted on the housing 15, communicating with the pumping chamber 23 and including a normally-closed spring biased check valve 43 which prevents flow from the pumping chamber 23 in response to piston assembly movement which decreases the volume of the pumping chamber 23 and which permits inflow to the pumping chamber 23 in response to piston assembly movement which increases the volume of the pumping chamber 23. In turn, the fitting 41 is connected through the conduit 245 with the source 227 of lubricating oil, for example, the previously mentioned oil tank which gravity feeds oil to the fitting 41.

Means are also provided for delivering oil from the pumping chamber 23. While other arrangements can be employed, in the illustrated construction, such means comprises first valved port means 51 including an axial bore 53 in the piston assembly plunger or stem 37, together with a normally closed spring biased check valve 55 which controls flow through the bore 53 and which prevents flow in response to piston assembly movement causing an increase in the volume of the pumping chamber 23 and which permits flow in response to piston assembly movement decreasing the volume of the pumping chamber 23.

The second piston means 35 of the piston assembly 31 is movable in and cooperates with the second recess or chamber 19 to divide the second recess or chamber 19 into an outlet chamber 61 including an outlet port 63 communicating through a conduit 65 with a carburetor float bowl 67 or the like, and a fuel inlet chamber 69 which communicates with the valve controlled axial bore 53 in the plunger or stem 37 and with an inlet duct or fitting 71 communicating through the conduit 235 with a suitable source of fuel under pressure, as for instance, the fuel pump 233 which can be actuated by alternating engine pressures, as for instance, by crankcase pressures.

While various arrangements can be employed, the second piston means 35 comprises a central disc or piston member 81 which is fixedly connected through a suitable intermediate structure 83 to the plunger or stem 37 of the first piston means 33 and a peripheral flexible membrane 85 which is suitably sealingly connected to the central disc 81 and to the housing 15 so as to divide the second recess 19 into the fuel outlet chamber 61 and the fuel inlet chamber 69 and to permit piston assembly movement within the second recess 19 so as to inversely vary the volumes of the fuel outlet chamber 61 and the fuel inlet chamber 69.

The intermediate structure 83 which connects the central disc 81 to the plunger or stem 37 is of lesser size than the surrounding wall portions 91 of the housing 15 so as thereby to provide an outer area 93 between the housing 15 and the intermediate structure 83. In addition, the intermediate structure 83 defines a hollow central area 95 which communicates with the axial bore 53 in the plunger or stem 37 and through one or more ports 97 with the outer area 93 surrounding the intermediate structure 83. Both the central area 95 and the outer area 93 form the fuel inlet chamber 69.

Means are provided for biasing the piston assembly 31 to locate the plunger or stem 37 in the position minimizing the volume of the pumping chamber 23 and to position the second piston means 35 so as to maximize the volume of the fuel outlet chamber 61 and to minimize the volume of the fuel inlet chamber 69. While various arrangements can be employed, in the illustrated construction, such means comprises a compression spring 103 which, at one end, is seated against the central disc 81 of the second piston means 35 and which, at the other end, is seated against an opposing wall portion 105 of the housing 15. Any suitable means can be employed, such as annular guide rings 106 and 108, to retain the piston assembly biasing spring 103 in the desired location.

While various other arrangements can be employed, the second piston means 35 includes a second valved port means which opens selectively to permit flow from the fuel inlet chamber 69 to the outlet chamber 61. While various arrangements can be employed, in the illustrated construction, such means comprises a central port or aperture 113 in the central disc 81, together with a valve seat 115 surrounding the port 113 on the fuel inlet side of the central disc 81, and a valve member 117 which is movable relative to the valve seat 115 between a fully open position, a partially open position and a closed position to control flow from the fuel inlet chamber 69 to the outlet chamber 61.

Means are provided for biasing the valve member 117 away from the valve seat 115. While various arrangements can be employed, in the illustrated construction, such means comprises a compression spring 121 which is located in radially inward relation to the piston assembly biasing spring 103, which at one end, bears against the housing wall portion 105, and which, at the other end, bears against the valve member 117. Any suitable means can be provided for retaining the valve member biasing spring 121 in the desired location.

Means are provided for limiting movement of the valve member 117 in the direction away from the wall portion 105 and for locating the valve member 117 in sealing engagement with the valve seat 115 in response to piston assembly movement to the position minimizing the volume of the fuel inlet chamber 69. While various arrangements can be employed, in the illustrated construction, such means comprises a plurality of pins 123 (one shown) which respectively include, at one end, enlarged heads 125 adapted to engage the valve member 117, which respectively extend through guide apertures 127 in a transverse member or part 129 of the intermediate structure 83 to permit pin movement relative to the piston assembly 31, and which, at the other end, are adapted for engagement with the wall portion 91 partially defining the outer area 93 of the fuel inlet chamber 69. Thus, when the piston assembly 31 is in the position minimizing the volume of the fuel inlet chamber 69, the ends of the pins 123 engage the wall portion 91 and the heads 125 of the pins 123 engage the valve member 117 to press the valve member 117 sealingly against the valve seat 115 so as to prevent flow from the fuel inlet chamber 69 to the outlet chamber 61.

Means operable in response to piston assembly movement minimizing the volume of the outlet chamber 61 are provided in the outlet chamber 61 to define an intermediate chamber 130 communicating with the port 113 and providing resistance to flow from the intermediate chamber 130 to the outlet chamber 61 when the valve member 117 is in partially opened position so as thereby to effect reduction in the pressure differential between the inlet chamber 69 and the intermediate chamber 130 and thereby to cause movement of the valve member 117 to the fully opened position, whereby to substantially reduce the pressure differential between the inlet chamber 69 and the outlet chamber 61, and thereby to cause piston assembly movement minimizing the volume of the inlet chamber 69 in response to the action of the piston assembly biasing spring 103. While various arrangements can be employed, in the illustrated construction, such means comprises an annular flange or ring 131 extending inwardly of the outlet chamber 61 from the wall portion 105 in radially outward relation from the valve member biasing spring 121 and in radially inward relation from the piston assembly biasing spring 103. In addition, such means comprises a cooperating annular flange or ring 133 extending from the central disc 81 toward the wall portion 105 and movable into telescopic relation to the flange or ring 131 as the piston assembly 31 approaches the end of the stroke minimizing the volume of the outlet chamber 61 so as to telescopically form the intermediate chamber 130 and to provide resistance to flow from the intermediate chamber 130 to the outlet chamber 61.

Pilot means are also provided for guiding movement of the valve member 117 relative to the piston assembly 31. While various arrangements can be employed, in the illustrated construction, such means comprises a guide pin 141 on the transverse member 129 and a cooperating blind socket 143 on the valve member 117. In order to permit free relative movement between the valve member 117 and the intermediate structure 83 of the piston assembly 31, the guide pin 141 includes an axial vent bore 145 opening at the outer end thereof into the central area or part 95 of the fuel inlet and oil mixing chamber 69 beneath the transverse member 129.

In operation as thus far described, the pressure of the incoming fuel, coupled with a more or less continuous flow of fuel or fuel/oil mixture from the outlet chamber 61 in response to demand by a carburetor or other device for feeding or supplying fuel to the engine 209, serves to displace the piston assembly 31, against the action of the piston assembly biasing spring 103, toward the housing wall portion 105 so as to minimize the volume of the outlet chamber 61 and so as to maximize the volume of the fuel inlet chamber 69. The difference in pressure between the outlet chamber 61 and the fuel inlet chamber 69 is generally sufficient to overcome the action of the valve member biasing spring 121 until such time as the piston assembly 31 approaches the position which minimizes the volume of the outlet chamber 61 and maximizes the volume of the fuel inlet chamber 69. At such time, the annular flanges 131 and 133 telescopically engage to form the intermediate chamber 130, and, at about the same time, the force in the valve member biasing spring 121 overcomes the force resulting from the pressure differential between the outlet chamber 61 and the fuel inlet chamber 69 and causes displacement of the valve member 117 from the valve seat 115, thereby displacing the port 113 to the partially opened position.

Such port opening results in limited flow of fuel or fuel/oil mixture from the fuel inlet chamber 69 to the intermediate chamber 130 and thence, through a restricted path between the telescopically engaged annular flanges 131 and 133 to the outlet chamber 61. Fuel flow from the intermediate chamber 130 to the outlet chamber 61 involves a pressure drop which causes reduction in the pressure drop occurring incident to partial opening of the valve member 117. Such diminishment of the pressure differential between the inlet chamber 69 and the intermediate chamber 130 has the effect of substantially increasing the force differential tending to displace the valve member 117 to the fully open position and causes such action. Movement of the valve member 117 to the fully open position causes dissipation of the pressure differential, thereby permitting displacement of the piston assembly 31, by the piston assembly biasing spring 103, to the position (shown in full lines) in which the volume of the outlet chamber 61 is maximized and the volume of the fuel inlet chamber 69 is minimized. Such displacement also serves to re-seat the valve member 117 against the valve seat 115, as already explained, and thereby again to establish a pressure differential between the outlet chamber 61 and the fuel inlet and oil mixing chamber 61, thereby instituting the beginning of a second operational cycle.

While the piston assembly 31 is moving from the full line position to the dotted line position so as to minimize the volume of the outlet chamber 61 and to eventually cause opening of the port 113, at the same time, the piston plunger or stem 37 is moving in the cylindrical portion 21 of the first recess or chamber 17 so as to increase the volume of the oil pumping chamber 23 and thereby induce inflow of oil into the pumping chamber 23 through the check valve 43. When the port 113 in the second piston means 35 opens, and the piston assembly 31 is displaced toward the full line position minimizing the volume of the fuel inlet chamber 69, such movement also causes diminishment in the volume of the oil pumping chamber 23 and causes oil flow through the axial bore 53 in the piston plunger or stem 37 and into the fuel inlet chamber 69 of a given quantity of oil for each stroke of the piston assembly 31.

Thus, the incoming flow of pressurized fuel, together with the outflow of fuel or fuel/oil mixture upon demand by the carburetor or other using device, considered with the common stroke of the first and second piston means 33 and 35, causes oil pumping and mixing with the pressurized incoming fuel in a generally predetermined ratio depending upon the relative cross-sectional dimensions of the piston plunger or stem 37 and of the part of the second recess or chamber 19 traversed by the piston means 33. If desired the oil can be discharged from the oil pumping chamber in a manner other than as shown in FIG. 2 and can be supplied to any point of desired use.

Thus, a fuel/oil ratio of 50 to 1 can readily be obtained by dimensioning the cross-sectional area of the second recess or chamber 19 so as to be approximately 50 times the area of the piston assembly plunger or stem 37. In view of the fact that the piston assembly plunger or stem 37 and the second recess or chamber 19 are preferably generally cylindrical in construction, such a ratio can be obtained without undue enlargement of the second recess or chamber 19 relative to the first recess or chamber 17.

Means are also provided for adjustably regulating the quantity of oil delivered from the pumping chamber 23 in response to each piston assembly stroke which decreases the volume of the pumping chamber 23. While various constructions can be employed, in the illustrated construction, such means comprises formation of the housing 15 with wall means 151 defining a secondary chamber 153 freely communicating with the pumping chamber 23, together with a floating piston or plunger 155 movable in the secondary chamber 153 between a position adjacent to the pumping chamber 23 and a selectively adjustable position remote from the pumping chamber 23.

Still more particularly, the floating plunger or piston 155 is guided for movement at the opposite ends thereof within respective bores 157 and 159 formed in the housing 15. In particular, movement of the piston or plunger 155 through the bore 157 serves the dual purpose of affording guidance to movement of the piston or plunger 155 while, at the same time, affording enlargement and diminishment of the effective size of the pumping chamber 23.

Centrally thereof, the piston or plunger 155 includes an enlarged portion 161 to which is suitably fixed a second flexible membrane 163 which, at its periphery, is suitably fixedly secured to the housing 15 so that the volume of the secondary chamber 153 varies as the floating piston or plunger 155 moves toward and away from the pumping chamber 23.

Means are provided for limiting movement of the floating piston or plunger 155 relative to the pumping chamber 23 so as to establish the maximum and minimum volumes of the secondary chamber 153. While various arrangements can be employed, in the illustrated construction, such means comprises employment of a shoulder 165 on the floating piston or plunger 155, which shoulder 165 is engageable with a shoulder 167 on the housing wall means 151 defining the secondary chamber 153 so as to limit plunger movement toward the pumping chamber 23, thereby establishing the minimum volume of the secondary chamber 153. Maximum outward travel of the floating plunger or piston 155 away from the pumping chamber 23 is limited by means comprising (see FIG. 3) a pair of spaced legs 171 extending from the housing 15 and supporting a shaft 173 carrying thereon a cam member 175 having a peripheral caming surface 177 which is adapted to be engaged by the outer end of the floating piston or plunger 155 so as to limit the movement of the plunger away from the pumping chamber 23, thereby establishing the maximum volume of the secondary chamber 153. The caming surface 177 is formed such that rotation of the shaft 173 varies the permissible stroke of the secondary or floating plunger 155, i.e., permits variation in the outward movement or maximum volume of the secondary chamber 153 depending upon the angular position of the shaft 173.

Preferably, the extent of the stroke of the secondary or floating piston or plunger 155 is adjustably controlled in accordance with the setting of an engine throttle 181 or some other engine parameter. Thus, while other constructions could be employed, in the illustrated construction, such means comprises a crank 183 which extends fixedly from the shaft 173 and which carries a roller 185 which is in engagement with a throttle positioning mechanism or linkage 187 so that the cam member 175 is angularly displaced in response to the throttle movement. In this last regard, the caming surface 177 is shaped so as to permit greater outward movement of the secondary or floating plunger 155 when the throttle 181 is in the idle position and to permit lesser outward movement of the secondary or floating plunger 155 when the throttle 181 is in an advanced engine speed setting.

In operation, when the piston assembly 31 moves outwardly from the pumping chamber 23, the floating piston or plunger 155 is drawn inwardly to its position establishing minimum volume of the secondary chamber 153 prior to actuation of the check valve 43 to supply oil to the pumping chamber 23. Upon movement of the piston assembly 31 inwardly toward the pumping chamber 23 so as to decrease the volume of the pumping chamber 23 and thus deliver oil from the axial bore 53, such initial inward movement causes outward displacement of the secondary or floating piston or plunger 155 into engagement with the caming surface 177 and effects transfer of fluid from the pumping chamber 23 to the secondary chamber 153 before effecting any increase in pressure such as would be effective to open the check valve 55 to afford fluid flow from the pumping chamber 23 incident to completion of the inward stroke of the piston assembly 31. Thus, if the cam member 175 is located so as to prevent any movement of the secondary or floating plunger 155, the entire stroke of the piston assembly 31 can be effective to draw oil into the pumping chamber 23 through the check valve 43 and to force oil out of the pumping chamber through the check valve 55. However, to the extent that secondary or floating plunger or piston movement is permitted in response to movement of the piston assembly 31, a portion of the stroke of the piston assembly 31 will be wasted, i.e., will cause movement of the floating piston or plunger 155 without causing pumping operation. Thus, by varying the permissible stroke of the floating piston or plunger 155, the rate of oil delivery from the pumping chamber 23 can be varied and, accordingly, the ratio of oil to fuel can also be varied.

The secondary chamber and plunger arrangement can be employed with pumping arrangements other than that disclosed in detail herein so as to vary the effective pumping rate of a pump which includes a main pumping piston which moves through a stroke of predetermined length. In addition, if desired, the floating piston can be directly movable into and out of the pumping chamber.

Figure 4:
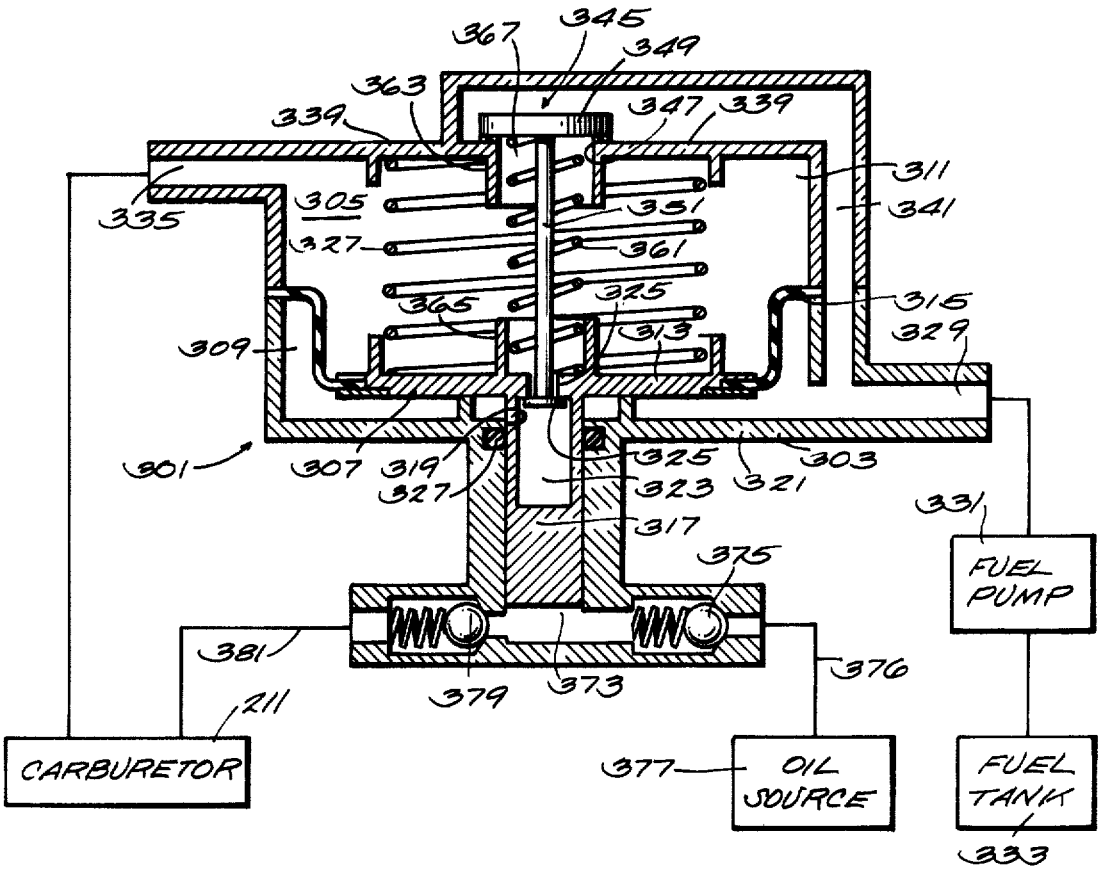
FIG. 4 is a schematic view of a modified pump incorporating various of the features of the invention.

Shown in FIG. 4 is another embodiment of an oil pump 301 which is powered by fuel under pressure and which can be employed in the outboard motor 201 shown in FIG. 1. The oil pump 301 comprises a housing 303 including wall means defining an internal cavity 305. Located within the cavity 305 for reciprocal movement therein is a suitable piston means 307 which divides the cavity 305 into a lower inlet chamber 309 which varies in volume with movement of the piston means 307 and an upper outlet chamber 311 which varies in volume with movement of the piston means 307 and inversely to the variation in volume of the inlet chamber 309.

While other constructions can be employed, the piston means 307 comprises a rigid piston 313 having secured to the periphery thereof a flexible membrane or diaphragm 315 which, in turn, at its periphery, is suitably secured to the housing 303. Accordingly, the piston means 307 is not ported and flow between the inlet chamber 309 and the outlet chamber 311 through the piston means 307 is precluded.

On its undersurface, the piston 313 includes a downwardly projecting portion or plunger part 317 which extends through an opening 319 in the bottom wall 321 of the housing 303 and which, as will be referred to hereinafter, has formed therein a recess or void 325 extending in the direction of piston reciprocation for a substantial length and which has an entrance opening 325 of lesser cross-section than the cross-section of the recess or void 322. A suitable seal 327 is provided between the plunger 327 and the housing 303 to prevent loss of fuel from the inlet chamber 309.

The inlet chamber 309 communicates through a conduit 329 with a suitable source 331 of fuel under pressure, i.e., with a suitable fuel pump which, in turn, communicates with a suitable source 333 of fuel, i.e., a fuel tank.

The outlet chamber 311 communicates through a conduit 335 with a desired point of use, for instance, the float bowl of the carburetor 211 of the internal combustion engine 209.

The pump 301 also includes means biasing the piston means 307 in the direction minimizing the volume of the inlet chamber 309. While other constructions can be employed, in the illustrated construction, such means comprises a helical coil spring 337 which, at one end, bears against the piston 313, and at the other end, bears against the upper wall 339 of the housing 303.

The pump 301 also includes, preferably within the housing 303, a bypass conduit 341 which communicates openly with the inlet chamber 309 and which is communicable with the outlet chamber 311 through suitable valve means 345. In the disclosed construction, such valve means 345 comprises a port 347 in the upper wall 339 of the housing 303, together with a valve member 349 which is movable relative to the port 347 between opened and closed positions.

Means are provided for closing the valve member 349 relative to the port 347 in response to piston movement minimizing the volume of the inlet chamber 309. While other constructions can be employed, in the illustrated construction, such means comprises a rod or stem 351 which fixedly extends from the valve member 349 and which projects through the entrance opening 325 and into the enlarged void or recess 323 in the piston 313 and which includes a head 353 which is larger in cross section than the entrance opening 325. This arrangement permits relative movement between the piston 313 and the valve member 349 during the greater part of the piston stroke, while additionally serving to effect common movement of the valve member 349 with the piston 313 during the last part of the stroke which minimizes the volume of the inlet chamber 309 so as to thereby seat the valve member 349 and close the port 347.

Means are also provided for opening the port 347 in response to displacement of the piston 313 in the direction minimizing the volume of the outlet chamber 311. While other constructions can be employed, the disclosed construction includes a valve biasing spring 361 which at one end, bears against the valve member 349, which extends through the port 347, and which, at the other end, bears against the piston 313. As in the embodiment shown in FIG. 2, telescopically engageable rings 363 and 365 respectively extend from the upper wall 339 and from the piston 313 to establish an intermediate chamber 367 and thereby to insure opening of the valve means 345 as the piston 313 minimizes the volume of the outlet chamber 311.

Means are also provided for pumping oil in response to piston reciprocation. While various constructions can be employed, the plunger part 317 of the piston 313 extends into a housing extension 317 including wall means defining a variable valve oil pumping chamber 373 which communicates through a suitable inlet check valve 375 and conduit 376 with a suitable source 377 of oil and which communicates through a suitable discharge check valve 379 and a discharge conduit 381 which, inturn, can communicate with the conduit 335 extending from the outlet chamber 311 for mixing in the conduit 335 of the discharged oil with the fuel discharged from the outlet chamber 311. Of course, the discharged oil can be supplied at any desired point for any desired reason.

As in the embodiment shown in FIG. 2, suitable means (not shown) can be provided for varying the discharge rate of the oil pump in accordance with engine throttle setting or otherwise.

In operation, the pressure of the incoming fuel serves, assuming closure of the port 347, to displace the piston means 307 against the action of the piston biasing spring 337 in the direction minimizing the volume of the outlet chamber 311 and maximizing the volume of the inlet chamber 309. During such movement, the inlet chamber 309 fills with fuel and the fuel in the outlet chamber 311 is discharged through the conduit 335. As the piston means 307 approaches the position minimizing the volume of the outlet chamber 311, the rings 363 and 365 telescopically engage to form the intermediate chamber 367 and the valve member 349 is displaced to the opened position by the valve biasing spring 361. When the valve means 345 opens, fuel flows from the inlet chamber 309 through the bypass conduit 341 and into the outlet chamber 311, causing displacement of the piston means 307 in the direction which mazimizes the volume of the outlet chamber 311 and minimizes the volume of the inlet chamber 309. As the piston means 307 approaches the position minimizing the volume of the inlet chamber 309, the valve member 349 is closed and the fuel pressure again begins to displace the piston means 307 in the direction minimizing the volume of the outlet chamber 311. During such movement, fuel is discharged from the outlet chamber 311 and drawn into the inlet chamber 309. In addition, the reciprocating motion of the piston means 309 also causes the operation of the piston plunger part 317 to discharge oil from the oil pumping chamber 373.

Various of the features of the invention are set forth in the following claims.

I claim:

1. A marine propulsion device comprising a lower unit including a lower end, and a propeller rotatably mounted in said lower end, a power head comprising an engine including a fuel feeding means, and an output shaft drivingly connected to said propeller, means adapted for mounting said lower unit to the transom of a boat and for vertical tilting movement and horizontal steering movement relative to the boat, means defining a source of oil, means defining a source of fuel, and means, including an outlet connected to said fuel feeding means, a first inlet connected to said oil source, and a second inlet connected to said fuel source, for pumping oil and supplying fuel to said fuel feeding means, said oil pumping and fuel supplying means being operable, in response to consumption of fuel by said fuel feeding means and in response to the presence of a pressure differential between said outlet and said second inlet.

2. A marine propulsion device in accordance with claim 1 wherein said means defining a source of fuel comprises a fuel pump including an input adapted to be connected to a fuel supply and an output connected to said second inlet of said oil pumping and fuel supplying means.

3. A marine propulsion device in accordance with claim 2 wherein said fuel pump is mounted on and driven by said engine.

4. A marine propulsion device in accordance with claim 2 wherein said fuel pump is located remotely from said engine.

5. A marine propulsion device in accordance with claim 1 wherein said oil pumping and fuel supplying means comprises a housing including piston means reciprocably movable within said housing and dividing said housing into an inlet chamber which varies in volume in accordance with piston means movement and which is adapted to be connected to a source of fuel which is under pressure and which biases said piston means in the direction maximizing the volume of said inlet chamber, and an outlet chamber which varies in volume in accordance with piston means movement and oppositely from the variation in volume of said inlet chamber and which is adapted to be connected to a point of use for the fuel, means biasing said piston means in the direction minimizing the volume of said inlet chamber, a conduit bypassing said piston means and communicating with said inlet chamber, valve means communicating between said bypass conduit and said outlet chamber and including means defining a port in said housing communicating with said outlet chamber and a valve member movable relaive to said port between opened and closed positions, means operable in response to displacement of said piston means minimizing the volume of said outlet chamber for displacing said valve member to the opened position, means operable in response to displacement of said piston means minimizing the volume of said inlet chamber for displacing said valve member to the closed position, and means adapted for communication with a source of oil for pumping oil in response to reciprocation of said piston means.

6. A marine propulsion device in accordance with claim 5 wherein said means for displacing said valve member to the opened position comprises means biasing said valve member to the opened position, and means on said housing and on said piston means operable to define an intermediate chamber between said outlet chamber and said by-pass conduit as said piston means approaches the position minimizing the volume of said outlet chamber.

7. A marine propulsion device in accordance with claim 5 wherein said means for displacing said valve member to the closed position comprises a rod extending fixedly from said valve member and across said outlet chamber and including means thereon cooperating with said piston means for displacing said valve member to the closed position in common with displacement of said piston means as said piston means approaches the position minimizing the volume of said inlet chamber and for affording lost motion between said valve member and said piston means during other parts of the stroke of said piston means.

8. A marine propulsion device in accordance with claim 5 wherein said valve member is movable to a partially open position between said open position and said closed position, whereby, when said valve member is in said closed position, and when supply of fuel to said inlet chamber and drainage of fuel from said outlet chamber creates a pressure differential between said inlet and outlet chambers, said piston means moves against the action of said piston means biasing means so as to minimize the volume of said outlet chamber, means biasing said valve member in the direction toward said fully opened position and operable, in response to piston assembly movement minimizing the volume of said outlet chamber, to displace said valve member to said partially open position permitting limited fluid flow from said inlet chamber to said outlet chamber when said valve member biasing means exerts a force which is equal to or slightly greater than the force resulting from the pressure differential between said inlet and outlet chambers, and means in said outlet chamber operable, in response to piston assembly movement minimizing the volume of said outlet chamber, to define an intermediate chamber communicating with said port and providing resistance to flow from said intermediate chamber to said outlet chamber when said valve member is in said partially open position so as thereby to effect reduction in the pressure differential between said inlet chamber and said intermediate chamber and thereby to cause movement of said valve member to said fully opened position, whereby to substantially reduce the pressure differential between said inlet chamber and said outlet chamber, and thereby to cause piston means movement minimizing the volume of said inlet chamber in response to the action of said piston means biasing means.

9. A marine propulsion device in accordance with claim 8 wherein said oil pumping means includes a pumping chamber of variable volume, a plunger connected to said piston means for common movement therewith in said pumping chamber and a floating piston movable relative to said pumping chamber so as to decrease the volume of said pumping chamber in response to plunger movement which increases the volume of said pumping chamber, and so as to increase the volume of said pumping chamber in response to plunger movement which decreases the volume of said pumping chamber.

10. A marine propulsion device in accordance with claim 9 and further including means for limiting movement of said floating piston so as to selectively vary the amount of variation in the volume of said pumping chamber.

11. A marine propulsion device in accordance with claim 10 wherein said means for limiting floating piston movement includes means for limiting floating piston movement which decreases the volume of said pumping chamber, and means for adjustably limiting floating piston movement which increases the volume of said pumping chamber.

12. A marine propulsion device in accordance with claim 10 and further including an engine throttle controlling linkage which can be selectively and adjustably set, and means operably connecting said engine throttle controlling linkage and said means for limiting floating piston movement so as to selectively vary the amount of variation in the volume of said pumping chamber in response to the setting of said engine throttle controling linkage.

13. A marine propulsion device in accordance with claim 10 wherein said pumping means further includes a secondary chamber communicating with said oil pumping chamber, wherein said plunger is movable in said oil pumping chamber, and wherein said floating piston is movable in said secondary chamber.

14. A marine propulsion device in accordance with claim 1 wherein said oil pumping and fuel supply means is mounted on said engine and comprises a housing including first and second recesses communicating with each other, a piston assembly located in said housing and including first piston means movable in said first recess and, in cooperation with said housing, defining a variable volume oil pumping chamber communicating with said source of oil, and second piston means movable in said second recess and, in cooperation with said housing, dividing said second recess into a variable volume outlet chamber having means adapted for delivering fuel to said fuel feeding means, and into an inlet chamber which is variable in volume in inverse relation to variation in volume of said outlet chamber, and which communicates with said fuel source, means biasing said piston assembly so as to minimize the volume of said inlet chamber and said oil pumping chamber, first valved port means communicating between said oil pumping chamber and said second recess and including therein first valve means preventing flow from said second recess to said oil pumping chamber incident to increase in the volume of said oil pumping chamber and permitting flow from said oil pumping chamber to said second recess in response to reduction in the volume of said oil pumping chamber, second valved port means communicating between said outlet chamber and said inlet chamber and including therein second valve means movable between a fully open position, a partially open position, and a closed position, whereby, when said second valve means is in said closed position, supply of fuel under pressure to said inlet chamber and drainage of fuel from said outlet chamber creates a pressure differential between said inlet and outlet chambers causing piston assembly movement against the action of said piston assembly biasing means so as to minimize the volume of said outlet chamber, means biasing said second valve means in the direction toward said fully open position and operable, in response to piston assembly movement minimizing the volume of said outlet chamber, to displace said second valve means to said partially open position permitting limited fluid flow from said inlet chamber to said outlet chamber when said valve biasing means exerts a force which is equal to or slightly greater than the force resulting from the pressure differential between said inlet and outlet chambers, and means in said outlet chamber operable, in response to piston assembly movement minimizing the volume of said outlet chamber, to define a intermediate chamber communicating with said second valved port means and providing resistance to flow from said intermediate chamber to said outlet chamber when said second valve means is in said partially open position so as thereby to effect reduction in the pressure differential between said inlet chamber and said intermediate chamber and thereby to cause movement of said second valve means to said fully open position, whereby to substantially reduce the pressure differential between said inlet chamber and said outlet chamber, and thereby to cause piston assembly movement minimizing the volume of said inlet chamber in response to the action of said piston assembly biasing means.

15. A marine propulsion device in accordance with claim 14 and further including a floating piston movable relative to said pumping chamber so as to decrease the volume of said pumping chamber in response to first piston means movement which increases the volume of said pumping chamber, and so as to increase the volume of said pumping chamber in response to first piston means movement which decreases the volume of said pumping chamber.

16. A marine propulsion device in accordance with claim 15 and further including means for limiting movement of said floating piston so as to selectively vary the amount of variation in the volume of said pumping chamber.

17. A marine propulsion device in accordance with claim 1 and further including a shroud surrounding said engine and wherein said means defining a source of oil comprises an oil tank formed in said shroud and located above said oil pumping and fuel supplying means, whereby to supply oil to said oil pumping and fuel supplying means under a gravity head.

18. A marine propulsion device in accordance with claim 1 wherein said means defining a source of oil comprises an oil tank mounted on said engine and above said oil pumping and fuel supplying means, whereby to supply oil to said oil pumping and fuel supplying means under a gravity head.

19. A marine propulsion device in accordance with claim 1 wherein said means defining a source of oil comprises an oil pump located remotely from said engine.

20. A marine propulsion device in accordance with claim 1 wherein said means defining a source of oil comprises an oil tank located remotely from said engine.

21. An oil pump and fuel supply device comprising a housing including piston means reciprocably movable within said housing and dividing said housing into an inlet chamber which varies in volume in accordance with piston means movement and which is adapted to be connected to a source of fuel which is under pressure and which biases said piston means in the direction maximizing the volume of said inlet chamber, and an outlet chamber which varies in volume in accordance with piston means movement and oppositely from the variation in volume of said inlet chamber and which is adapted to be connected to a point of use for the fuel, means biasing said piston means in the direction minimizing the volume of said inlet chamber, a conduit bypassing said piston means and communicating with said inlet chamber, valve means communicating between said bypass conduit and said outlet chamber and including means defining a port in said housing communicating with said outlet chamber and a valve member movable relative to said port between open and closed positions, means operable in response to displacement of said piston means minimizing the volume of said outlet chamber for displacing said valve member to the opened position, means operable in response to displacement of said piston means minimizing the volume of said inlet chamber for displacing said valve member to the closed position, and means adapted for communication with a source of oil for pumping oil in response to reciprocation of said piston means.

22. An oil pump and fuel supply device in accordance with claim 21 wherein said means for displacing said valve member to the opened position comprises means biasing said valve member to the opened position and means on said housing and on said piston means operable to define an intermediate chamber between said outlet chamber and said by-pass conduit as said piston means approaches the position minimizing the volume of said outlet chamber.

23. An oil pump and fuel supply device in accordance with claim 21 wherein said means for displacing said valve member to the closed position comprises a rod extended fixedly from said valve member and across said outlet chamber and including means thereon cooperating with said piston means for displacing said valve member to the closed position in common with displacement of said piston means as said piston means approaches the position minimizing the volume of said inlet chamber and for affording lost motion between said valve member and said piston means during other parts of the stroke of said piston means.

24. An oil pump and fuel supply device in accordance with claim 21 wherein said valve member is also movable to a partially open position intermediate the said open position and said closed position, whereby, and when supply of fuel to said inlet chamber and drainage of fuel from said outlet chamber creates a pressure differential between said inlet and outlet chambers, said piston means moves against the action of said piston means biasing means so as to minimize the volume of said outlet chamber, means biasing said valve member in the direction toward said open position and operable, in response to piston means movement minimizing the volume of said outlet chamber, to displace said valve member to said partially open position permitting limited fluid flow from said inlet chamber to said outlet chamber when said valve member biasing means exerts a force which is equal to or slightly greater than the force resulting from the pressure differential between said inlet and outlet chambers, and means in said outlet chamber operable, in response to piston assembly movement minimizing the volume of said outlet chamber, to define an intermediate chamber communicating with said port and providing resistance to flow from said intermediate chamber to said outlet chamber when said valve member is in said partially open position so as thereby to effect reduction in the pressure differential between said inlet chamber and said intermediate chamber and thereby to cause movement of said valve member to said opened position, whereby to substantially reduce the pressure differential between said inlet chamber and said outlet chamber, and thereby to cause piston means movement minimizing the volume of said inlet chamber in response to the action of said piston means biasing means.

25. An oil pump and fuel supply device in accordance with claim 24 wherein said oil pumping means includes a pumping chamber of variable volume, a plunger connected to said piston means for common movement therewith in said pumping chamber, a floating piston movable relative to said pumping chamber so as to decrease the volume of said pumping chamber in response to plunger movement which increases the volume of said pumping chamber, and so as to increase the volume of said pumping chamber in response to plunger movement which decreases the volume of said pumping chamber.

26. An oil pump and fuel supply device in accordance with claim 25 and further including means for limiting movement of said floating piston so as to selectively vary the amount of variation in the volume of said pumping chamber.

27. An oil pump and fuel supply device in accordance with claim 26 wherein said means for limiting floating piston movement includes means for limiting floating piston movement which decreases the volume of said pumping chamber, and means for adjustably limiting floating piston movement which increases the volume of said pumping chamber.

28. An oil pump and fuel supply device in accordance with claim 28 and further including an engine throttle controlling linkage which can be selectively and adjustably set, and means operably connecting said engine throttle controlling linkage and said means for limiting floating piston movement so as to selectively vary the amount of variation in the volume of said pumping chamber in response to the setting of said engine throttle controlling linkage.

29. An oil pump and fuel supply device in accordance with claim 26 wherein said oil pumping means further includes a secondary chamber communicating with said oil pumping chamber, wherein said plunger is movable in said oil pumping chamber, and wherein said floating piston is movable in said secondary chamber.

30. A combined oil pumping and fuel supplying device comprising a housing including a recess, a piston assembly located in said housing and including a piston movable in said recess and, in cooperation with said housing, dividing said recess into a variable volume outlet chamber having means adapted for delivering fuel to a delivery point, and into an inlet chamber which is variable in volume in inverse relation to variation in volume of said outlet chamber and which is adapted to communicate with a supply of fuel under pressure, means biasing said piston assembly so as to minimize the volume of said inlet chamber, valved port means communicating between said outlet chamber and said inlet chamber and including therein valve means movable between a fully open position, a partially open position, and a closed position, whereby, when said valve means is in said closed position, and when supply of fuel to said inlet chamber and drainage of fuel from said outlet chamber creates a pressure differential between said inlet and outlet chambers, said piston assembly moves against the action of said piston assembly biasing means so as to minimize the volume of said outlet chamber, means biasing said valve means in the direction toward said fully open position and operable, in response to piston assembly movement minimizing the volume of said outlet chamber, to displace said valve means to said partially open position permitting limited fluid flow from said inlet chamber to said outlet chamber when said valve biasing means exert a force which is slightly greater than the force resulting from the pressure differential between said inlet and outlet chambers, means in said outlet chamber operable, in response to piston assembly movement minimizing the volume of said outlet chamber, to define an intermediate chamber communicating with said valved port means and providing resistance to flow from said intermediate chamber to said outlet chamber when said valve means is in said partially open position so as thereby to effect reduction in the pressure differential between said inlet chamber and said intermediate chamber and thereby to cause movement of said valve means to said fully open position, whereby to substantially reduce the pressure differential between said inlet chamber and said outlet chamber, and thereby to cause piston assembly movement minimizing the volume of said inlet chamber in response to the action of said piston assembly biasing means, and means adapted to be connected to a source of oil for pumping oil in response to piston assembly movement.

31. A combined oil pumping and fuel supplying device comprising a housing including first and second recesses communicating with each other, a piston assembly located in said housing and including first piston means movable in said first recess and, in cooperation with said housing, defining a variable volume oil pumping chamber, and second piston means movable in said second recess and, in cooperation with said housing, dividing said second recess into a variable volume outlet chamber having means adapted for delivering fuel to a delivery point, and into an inlet chamber which is variable in volume in inverse relation to variation in volume of said outlet chamber, and which is adapted to communicate with a supply of fuel, means biasing said piston assembly so as to minimize the volume of said inlet chamber and said oil pumping chamber, first valved port means communicating between said oil pumping chamber and said second recess and including therein first valve means preventing flow from said second recess to said oil pumping chamber incident to increase in the volume of said oil pumping chamber and permitting flow from said oil pumping chamber to said second recess in response to reduction in the volume of said oil pumping chamber, second valved port means communicating between said outlet chamber and said inlet chamber and including therein second valve means movable between a fully open position, a partially open position, and a closed position, whereby, when said second valve means is in said closed position, and when supply of fuel to said inlet chamber and drainage of fuel from said outlet chamber creates a pressure differential between said inlet and outlet chambers, said piston assembly moves against the action of said piston assembly biasing means so as to minimize the volume of said outlet chamber, means biasing said second valve means in the direction toward said fully open position and operable, in response to piston assembly movement minimizing the volume of said outlet chamber, to displace said second valve means to said partially open position permitting limited fluid flow from said inlet chamber to said outlet chamber when said valve biasing means exerts a force which is equal to or slightly greater than the force resulting from the pressure differential between said inlet and outlet chamber, and means in said outlet chamber operable, in response to piston assembly movement minimizing the volume of said outlet chamber, to define an intermediate chamber communicating with said second valved port means and providing resistance to flow from said intermediate chamber to said outlet chamber when said second valve means is in said partially open position so as thereby to effect reduction in the pressure differential between said inlet chamber and said intermediate chamber and thereby to cause movement of said second valve means to said fully open position, thereby to substantially reduce the pressure differential between said inlet chamber and said outlet chamber, and thereby to cause piston assembly movement minimizing the volume of said inlet chamber in response to the action of said piston assembly biasing means.

32. A combined oil pumping and fuel supplying device in accordance with claim 31 wherein said first valved port means is located in said first piston means and wherein said second valved port is located in said second piston means.

33. A combined oil pumping and fuel supplying device in accordance with claim 31 wherein said first valved port means communicates with said inlet chamber of said second recess.

34. A combined oil pumping and fuel supplying device in accordance with claim 31 wherein said first valved port means communicates with said outlet chamber of said second recess.

35. A combined oil pumping and fuel supplying device in accordance with claim 31 wherein said second valved port means includes means in said second piston means defining a port, and wherein said second valve means comprises a valve seat adjacent said port, and a valve member movable relative to said valve seat between a closed position engaged with said valve seat, an open position spaced relatively substantially from said valve seat, and a partially open position spaced from said valve seat at a lesser spacing than said open position.

36. A combined oil pumping and fuel supplying device in accordance with claim 31 and further including a floating piston movable relative to said pumping chamber so as to decrease the volume of said pumping chamber in response to first piston means movement which increases the volume of said pumping chamber, and so as to increase the volume of said pumping chamber in response to first piston means movement which decreases the volume of said pumping chamber.

37. A combined oil pumping and fuel supply device in accordance with claim 36 and further including means for limiting movement of said floating piston so as to selectively vary the amount of variation in the volume of said pumping chamber.

38. A combined oil pumping and fuel supplying device in accordance with claim 31 and wherein said housing includes a wall portion spaced from said second valve means and wherein said second valve member biasing means comprises a helical spring having one end engaged against said valve member and having a second end engaged with said wall portion.

39. A combined oil pumping and fuel supplying device in accordance with claim 31 wherein said housing includes a wall portion spaced from said second valve means, and wherein said means operable to define an intermediate chamber and to provide resistance to flow between said intermediate chamber and said outlet chamber comprises a first endless flange extending from said second piston means toward said wall portion, a second endless flange extending from said wall portion toward said second piston means and located for telescopic association with said first endless flange in response to second piston means movement toward said wall portion.

40. A combined oil pumping and fuel supplying device in accordance with claim 39 wherein said second piston assembly biasing means comprises a helical spring located outwardly of said first and second endless flanges and having one end bearing against said wall portion and a second end bearing against said second piston means.

41. A combined oil pumping and fuel supplying device in accordance with claim 31 wherein said housing includes check valve means communicating with said oil pumping chamber and permitting oil flow into said pumping chamber incident to an increase in the volume of said oil pumping chamber and preventing flow from said oil pumping chamber incident to a decrease in the volume of said oil pumping chamber.

* * * * *